US005661257A

United States Patent [19]

Nielson et al.

[11] Patent Number: 5,661,257

[45] Date of Patent: Aug. 26, 1997

[54] MULTISPECTRAL COVERT TARGET MARKER

[75] Inventors: Daniel B. Nielson, Brigham City; Brad A. Fairbourn, West Haven, both of Utah

[73] Assignee: Thiokol Corporation, Ogden, Utah

[21] Appl. No.: 591,170

[22] Filed: Jan. 16, 1996

[51] Int. Cl.[6] ..... F42B 12/42; F42B 12/48

[52] U.S. Cl. ..... 102/334; 102/336; 102/337; 102/340; 102/505; 102/513; 42/1.15; 362/110; 362/800

[58] Field of Search ..... 102/334, 336, 102/337, 340, 342, 348, 351, 354, 355, 357, 505, 513; 42/1.15; 362/110, 800

[56] References Cited

U.S. PATENT DOCUMENTS

| | | | |
|---|---|---|---|
| 1,588,639 | 6/1926 | Wiley . | |
| 1,686,117 | 10/1928 | Ball . | |
| 2,785,632 | 3/1957 | Clauser et al. | 102/340 |
| 3,049,080 | 8/1962 | Schermuly | 102/340 |
| 3,120,183 | 2/1964 | Wheelwright et al. | 102/334 |
| 3,432,857 | 3/1969 | Rasmussen et al. | 102/505 |
| 3,566,791 | 3/1971 | Lohkamp | 102/32 |
| 3,745,324 | 7/1973 | Shefler et al. | 240/2.25 |
| 3,837,281 | 9/1974 | Shaffer et al. | 102/35 |
| 3,841,219 | 10/1974 | Schillreff | 102/505 |
| 3,940,605 | 2/1976 | Gerber | 240/2.25 |
| 4,007,690 | 2/1977 | Wildridge | 102/334 |
| 4,032,374 | 6/1977 | Douda et al. | 149/19.8 |
| 4,178,854 | 12/1979 | Schillreff | 102/89 CD |
| 4,183,302 | 1/1980 | Schillreff | 102/89 CD |
| 4,286,498 | 9/1981 | Block et al. | 102/505 |
| 4,448,106 | 5/1984 | Knapp | 89/1 A |
| 4,622,899 | 11/1986 | Weber | 102/334 |
| 4,697,521 | 10/1987 | Espagnacq et al. | 102/334 |
| 4,838,167 | 6/1989 | Prahauser et al. | 102/334 |
| 4,989,881 | 2/1991 | Gamble | 362/110 |
| 5,025,729 | 6/1991 | Cameron | 102/336 |
| 5,154,782 | 10/1992 | Shaw et al. | 149/19.5 |
| 5,337,671 | 8/1994 | Varmo | 102/334 |
| 5,481,979 | 1/1996 | Walder | 102/355 |

*Primary Examiner*—Harold J. Tudor

*Attorney, Agent, or Firm*—Cushman Darby & Cushman IP Group of Pillsbury Madison & Sutro, LLP; Ronald L. Lyons, Esq.

[57] ABSTRACT

A covert, i.e., no visible light emitted, multispectral day/night target marker is disclosed. The marker emits a signature detectable in the electromagnetic spectrum including visible, near infrared, middle and longwave infrared, and radar regions. The marker is particularly useful for marking of target areas so that they can be easily detected from the ground or the air. The visible spectrum is marked by a white or colored pyrotechnic smoke generant. The near infrared region is marked by near infrared emitting photodiodes encased in a hardened polymeric molding compound. These diodes are only visible through night vision devices (image intensifiers). The middle through the far infrared regions are marked by the heat generated from the combustion of the pyrotechnic smoke generant. The smoke generant is housed in a canister having a highly emissive surface. The radar region is marked using radar chaff. The target marker is configured for use with conventional mortar or rocket delivered flare systems. A hand held, rocket-propelled parachute signal is disclosed which includes near infrared emitting photodiodes and oscillator electronics assembly encased in a hardened polymeric molding compound launched from a hand-fired expendable-type launcher.

25 Claims, 3 Drawing Sheets

MULTISPECTRAL COVERT TARGET MARKER

FIELD OF THE INVENTION

The present invention relates to covert (no visible light emitted) target markers. More specifically, the present invention is directed to multispectral covert target markers for use in marking enemy and/or friendly locations for identification by aircraft or ground personnel.

BACKGROUND OF INVENTION

Often it is desirable to mark areas on land so that the area can be easily identified and located. For instance, targets to be destroyed during military operations are often marked. In other military applications, markers are used to identify friend or foe.

Current target markers usually include a smoke producing pyrotechnic composition, such as a phosphorous obscurant compositions. Phosphorous rounds, which explode and scatter burning phosphorous, produce a large amount of heat and have been known to start fires. At night, such smoke producers are not covert because they produce visible light. Another known target marker, described in U.S. Pat. No. 3,940,605, is a chemiluminescent lighting apparatus which emits visible light. Yet another target marking device, described in U.S. Pat. No. 3,745,324, is a parachute soaked in a chemiluminescent agent which is dropped to the desired location.

U.S. Pat. No. 4,448,106 describes a device for marking hard targets, such as bridges, dams, boatways, bunkers, tanks, submarines, armed vehicles, and the like. The disclosed hard target markers include kinetic penetrator elements which partially penetrate the hard target. The penetrator elements may radiate energy upon impact, such as a radio frequency or a light emitted by a flare or a luminous dye.

From the foregoing, it will be appreciated that it would be an advancement in the art to provide a covert target marker which does not emit visible light but which is capable of marking target during the day or night.

Such covert target markers are disclosed and claimed herein.

SUMMARY OF THE INVENTION

The present invention is directed to a covert, i.e., no visible light emitted, multispectral day/night target marker. The marker emits a signature detectable in the electromagnetic spectrum from 0.4 microns to 14 microns and also in the radar (34 to 94 gigahertz) region. The marker is particularly useful for marking of target areas so that they can be easily detected from the ground or the air. The marker permits detection in the following spectral regions: visible, near infrared, middle and longwave infrared, and radar.

The visible spectrum is preferably marked by a conventional white or colored smoke formulation. The smoke formulation for covert application must not emit visible light. Therefore, suitable smoke formulations are based on the volatilization of organic molecules to form a smoke cloud that is visible during the daylight hours. The smoke cloud can be colored using conventional dyes for special signaling purposes.

The near infrared region is preferably marked by conventional near infrared emitting photodiodes. These diodes have no visible light emission and are only visible through night vision devices (image intensifiers) that operate between 0.4 microns and 1.0 microns. The photodiode is an electronically energized, continuous or pulsating infrared light emitting diode assembly preferably encased in a hardened polymeric molding compound. It provides a continuous or repeating, high intensity light signal in the near infrared spectrum that is visible from up to 10 miles away when using night vision equipment.

The middle through the far infrared regions are marked by the heat generated from the combustion of the covert smoke marker. The covert smoke composition is housed in a metal canister that has a highly emissive surface. The surface should have an emissivity between 0.8 and 1.0 to be most effective. The highly emissive surface greatly increases the intensity over the low emissivity surfaces. This allows the marker to be seen at greater distances when viewed through thermal imagers. Flat black paint has been used on canisters with great success.

The millimeter wavelength (radar) region is preferably marked using conventional radar chaff. The chaff preferably attenuates the radar signal in the 5 to 50 gigahertz region and is clearly visible through aircraft radar marking the general area of the initial marker deployment. The chaff is preferably the first signal deployed from the marker and is typically activated 2000 to 5000 feet above the target area. This allows aircraft to locate the general area from several miles away.

The target marker is preferably configured for use with conventional mortar or rocket delivered flare systems. Existing flare delivery vehicles may be readily modified for use in delivering the multispectral target marker according to the present invention. Examples of typical delivery systems include 60 mm, 81 mm, and 120 mm mortar fired cartridges, 105 mm howitzer fired cartridges, 155 mm projectiles, and 2.75 inch (70 mm) rocket launch systems. Hand held 40 mm signal systems may also be modified to use features of the present invention.

In operation, as the delivery vehicle approaches the target to be marked, the individual target marker components are ejected such that the smoke canister and the near infrared emitting photodiodes fall to the ground and the radar chaff is dispersed in the atmosphere above the target. The marker provides covert marking capability in the air and on the ground that enables aircraft and ground based personnel to locate covertly identified targets.

DETAILED DESCRIPTION OF THE INVENTION

Figure 1:
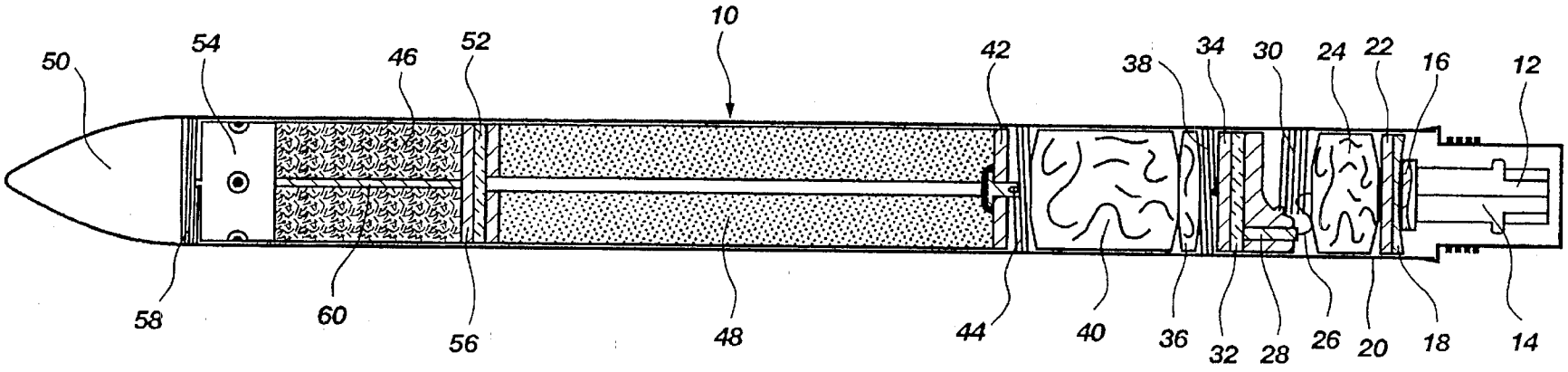
FIG. 1 is a cross-sectional view of a multispectral target marker embodiment within the scope of the present invention.

The present invention is directed to a covert multispectral day/night target marker. As used herein, the term "covert" means that no visible light is emitted by the target marker. The marker provides a detectable signature in several different electromagnetic spectral regions, including visible, near infrared, middle and longwave infrared, and radar regions. The multispectral marker is particularly useful for marking of target areas so that they can be easily detected from the ground or the air. Because no visible light is emitted, the covert target marker is ideal for marking targets at night.

A pyrotechnic smoke producing formation is preferably used to generate a detectable signature in the visible spectrum (from 0.4 to 0.7 microns). The smoke formulation for covert application must not emit visible light. The smoke generant used herein is preferably housed in a canister having a nozzle through which the smoke is emitted. The nozzle acts as a flame suppressant. Suitable smoke formulations are based on the volatilization of organic molecules to form a smoke cloud that is visible during the daylight hours. For instance, white smoke may be produced using cinnamic acid and sebacic acid smokes according to the disclosure of Douda et al., U.S. Pat. No. 4,032,374 and Shaw et al., U.S. Pat. No. 5,154,782. Other organic acids, such as salicylic acid, terephthalic acid, phthalic acid, vanillic acid, naphthenoic acid, and derivatives and mixtures thereof may also be used. Some metal alkyl smoke compositions may also be used in the present invention, provided the amount of visible light generated is negligible. Persons skilled in the art will appreciate that other known or novel smoke compositions can also be used in the present invention.

The smoke cloud can be colored using conventional dyes for special signaling purposes. Red smoke may be produced using disperse red 11, solvent red 1 dyes, or 1-(methylamino)anthraquinone. Yellow smoke may be prepared using solvent yellow 33. Green smoke may be prepared using a mixture of solvent yellow 33 and 1,4-bis(p-tolylamino)anthraquinone (solvent green 3) dyes. Those skilled in the art will appreciate that other dyes and mixtures of dyes can be used to prepare other colored smokes.

The pyrotechnic smoke producing formation is preferably included within a canister, such as those used in conventional smoke grenades. Because of the heat generated by the smoke generant, the canister becomes hot and emits infrared radiation in the mid infrared region (3–5 microns) and far infrared region (8–12 microns). It is currently preferred to coat the exterior surface of the canister with a highly emissive coating. The surface preferably has an emissivity between 0.8 and 1.0, and preferably greater than 0.9. Carbon has a very high emissivity. Flat black paint has been used on canisters with great success. The highly emissive surface increases the infrared emission intensity over the low emissivity surfaces. This allows the marker to be seen at greater distances when viewed through thermal imagers. The hot smoke and gases generated also emit a large, detectable infrared signature.

The near infrared region (in the range from about 0.7 to 1 microns) is preferably marked by near infrared emitting photodiodes. A currently preferred photodiode is the OP290 infrared LED (light emitting diode) manufactured by Optek Technology, Inc. When coupled with conventional oscillator electronics, the OP290 photodiode emits high intensity pulses in the spectral region from 0.850 microns to 0.930 microns. These diodes have no visible light emission and are only visible through night vision devices (image intensifiers) that operate between 0.4 microns and 1 microns. The infrared signal is visible up to 10 miles away using night vision equipment. It will be appreciated that other functionally equivalent photodiodes may also be used in the present invention.

It is currently preferred to encase the photodiodes and electronic components needed to operate the photodiodes in a hardened polymeric molding compound. A currently preferred polymeric molding compound is a dark amber polyurethane elastomer sold by Ciba-Geigy Corporation, East Lansing, Michigan and designated RENRP6414-3. Any polymeric molding compound with equivalent mechanical properties can be used. Suitable polymeric molding compounds must be capable of withstanding a fall of up to 1200 m and must be transparent to near infrared emissions.

It is currently preferred to configure the near infrared strobe in the general form of a hockey puck, that is, a thick disk sized to fit within a cylindrical housing of the desired delivery vehicle. The infrared strobe preferably includes switches which energize the device when the strobe is expelled from the delivery vehicle. The photodiodes can provide continuous or pulsating, high intensity near infrared emissions. Pulse frequency and duration can be tailored to meet the user's needs. The operation time can range from seconds to hours but typical duration time would likely be from 5 to 10 minutes.

The millimeter wavelength (radar) region is preferably marked using conventional radar chaff. The chaff preferably attenuates the radar signal in the 5 to 50 gigahertz region and is clearly visible through aircraft radar marking the general area of the initial marker deployment. The chaff is preferably the first signal deployed from the marker is typically activated 2000 to 5000 feet above the target area. This allows aircraft to locate the general area from several miles away.

One commercially available chaff package is manufactured by Loral Corporation having a size of 2.55 inches in diameter by 4.00 inches in length. The chaff attenuates radar frequencies between 5 and 50 gigahertz. The chaff package is disseminated by Prima Cord located in the center of the chaff package. Once disseminated, the chaff has a cross-sectional area of about 150 square meters.

The target marker is preferably configured for use with conventional mortar or rocket delivered flare systems. Existing flare delivery vehicles may be readily modified for use in delivering the multispectral target marker according to the present invention. Examples of typical delivery systems include 60 mm, 81 mm, and 120 mm mortar fired cartridges, 105 mm howitzer fired cartridges, 155 mm projectiles, and 2.75 inch (70 mm) rocket launch systems. Hand held, 40 mm signals can also be adapted to use features of the present invention, particularly the near infrared emitting photodiodes.

In use, as the delivery vehicle approaches the target to be marked, the chaff package is expelled from the marker and detonates above the target between about 2000 feet and 5000 feet above ground level. The smoke creates a line in the sky en route to the target area. When the parachute is deployed, it pulls out the near infrared photodiodes. The photodiodes remain tethered to the parachute. The marker provides covert marking capability in the air that enables aircraft and ground based personnel to locate covertly identified targets.

FIG. 1 illustrates a cross-sectional view of one possible multispectral target marker within the scope of the present invention. The target marker 10 is configured for use in connection with a conventional delivery vehicle, not shown, such as a mortar fired cartridge, howitzer fired cartridge or projectile, or a rocket motor. The components and operation of the multispectral target marker 10 illustrated in FIG. 1 will be described in connection with a rocket launched system.

Upon rocket motor acceleration, a setback fuse 12 and delay assembly 14 are activated. After a fixed time delay, the delay assembly 14 fires the primary expulsion charge 16. A deflector plate 18 directs the force of the expulsion charge 16 forward, against the pusher plate 22, severing the joint between the rocket motor adapter and the target marker case 20, thus separating the spent rocket motor from the remaining target marker assembly. The pusher plate 22 exits the rear of the target marker assembly deploying a drogue parachute 24 to which it is tethered.

Upon exiting the target marker case 20, the drogue parachute 24 pulls a lanyard 26 initiating a secondary ignition delay 28. After the drogue parachute is deployed, it acts to decelerate the target marker assembly via drogue parachute tether 30.

After the secondary ignition delay time interval expires, the secondary expulsion charge 32 is fired. This expulsion charge severs the drogue parachute 24 and opens the target marker case which enables the second pusher plate 34 to exit the target marker case. The pilot parachute 36 is pulled out of the target marker case via pilot parachute tether 38 attached to the second pusher plate 34. The pilot parachute 36, which remains tethered to the main parachute, assists in main parachute 40 deployment. The main parachute 40 is connected to target marker bulkhead 42 via the main parachute cable 44. The main parachute 40 further decelerates the target marker assembly.

When the secondary expulsion charge 32 functions, it ignites two tertiary ignition delays (not shown), one in a chaff package section 46 and one in a visible/IR smoke section 48, it releases the target marker assembly's front end ogive 50, and it initiates a tertiary expulsion charge 52. The tertiary expulsion charge 52 expels a near infrared strobe 54 and the chaff package 46, via a pusher plate 56, out of the target marker assembly. Although not illustrated in FIG. 1, the near infrared strobe can be pulled out with the main parachute. The near infrared strobe 54 remains in close proximity to the visible/infrared smoke section 48 by means of a tether 58.

Immediately upon exiting the target marker case, the near infrared strobe section 54 begins pulsating. Seconds after the chaff package clears the target marker case, its explosive center core 60 detonates, disseminating the chaff in a cloud above the target area. At approximately the same time the chaff section activates, the visible/infrared smoke section ignites and begins producing a smoke line in the sky.

The visible/infrared smoke section 48 and near infrared strobe section 54 land in the target zone and continue operating. The smoke composition burns for 2 to 4 minutes, generating a large infrared signature clearly visible with thermal imagers (sensitive to 3 to 5 and 8 to 12 micron infrared light emissions). The smoke also produces a visible smoke plume for use in daylight.

The near infrared strobe 54 emits light in the 0.88 micron region for use with night vision devices. The signal is completely invisible to the human eye and can only be seen using night vision equipment. The pulse frequency and duration can be tailored to the user's needs. The operation time can range from seconds to hours, but typical duration is 5 to 10 minutes.

Figure 2:
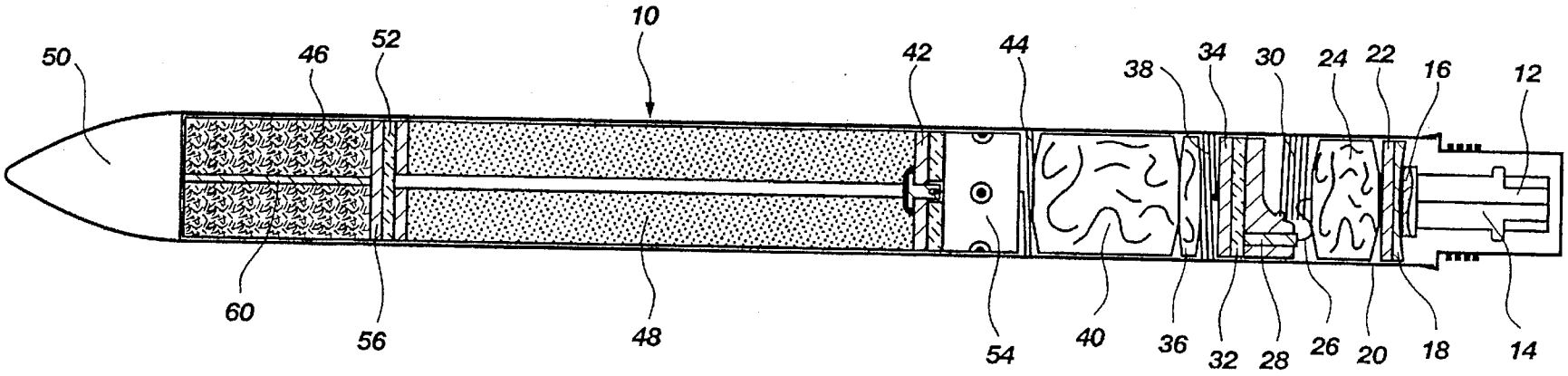
FIG. 2 is a cross-sectional view of a multispectral target marker embodiment within the scope of the present invention showing a different packing configuration from that shown in FIG. 1.

FIG. 2 illustrates a cross-sectional view of another possible multispectral target marker within the scope of the present invention similar to FIG. 1, except that the near infrared strobe 54 is attached to the main parachute cable. This configuration enables the strobe assembly to be easily activated and does not require the use of additional tethers to secure the strobe to the flare assembly. This design increases the accuracy of the target marker because it is more aerodynamic than the design of FIG. 1.

In operation, the setback fuse 12 and delay assembly 14 are activated upon rocket motor acceleration. After a fixed time delay, the delay assembly 14 fires the primary expulsion charge 16. A deflector plate 18 directs the force of the expulsion charge 16 forward, against the pusher plate 22, severing the joint between the rocket motor adapter and the target marker case 20, thus separating the spent rocket motor from the remaining target marker assembly. The pusher plate 22 exits the rear of the target marker assembly deploying a drogue parachute 24 to which it is tethered.

Upon exiting the target marker case 20, the drogue parachute 24 pulls a lanyard 26 initiating a secondary ignition delay 28. After the drogue parachute is deployed, it acts to decelerate the target marker assembly via drogue parachute tether 30.

After the secondary ignition delay time interval expires, the secondary expulsion charge 32 is fired. This expulsion charge severs the drogue parachute 24 and opens the target marker case which enables the second pusher plate 34 to exit the target marker case. The pilot parachute 36 is pulled out of the target marker case via pilot parachute tether 38 attached to the second pusher plate 34. The pilot parachute 36, which remains tethered to the main parachute, assists in main parachute 40 deployment. The main parachute 40 is connected to target marker bulkhead 42 via the main parachute cable 44. The main parachute 40 further decelerates the target marker assembly. Upon main parachute deployment, the near infrared strobe 54, which is attached to the main parachute cable 44, is pulled from inside the target marker case and begins strobing immediately.

When the secondary expulsion charge 32 functions, it ignites two tertiary ignition delays (not shown), one in a chaff package section 46 and one in a visible/IR smoke section 48. The expulsion charge releases the target marker assembly's front end ogive 50, and it expels the chaff package 46, via a pusher plate 56.

Seconds after the chaff package 46 clears the target marker case, its explosive center core 60 detonates, disseminating the chaff in a cloud above the target area. At approximately the same time the chaff section detonates, the visible/infrared smoke section 48 ignites and begins producing a smoke line in the sky.

The visible/infrared smoke section 48 and near infrared strobe section 54 land in the target zone and continue operating. The smoke composition burns for 2 to 4 minutes, generating a large infrared signature clearly visible with thermal imagers (sensitive to 3 to 5 and 8 to 12 micron infrared light emissions). The smoke also produces a visible smoke plume for use in daylight.

The near infrared strobe 54 emits light in the 0.7 to 1.0 micron region for use with night vision devices. The diode signal is completely invisible to the human eye and can only be seen using night vision equipment. The pulse frequency and duration can be tailored to the user's needs. The operation time can range from seconds to hours, but typical duration is 5 to 10 minutes.

Figure 3:
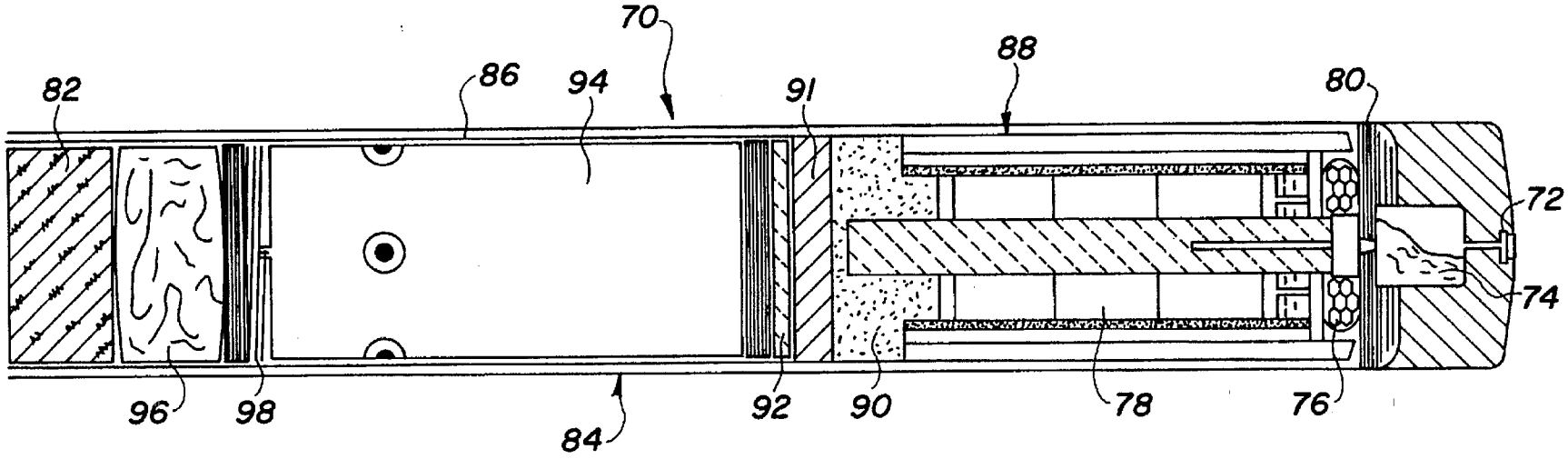
FIG. 3 is a cross-sectional view of a hand held, rocket-propelled parachute signal containing a covert near infrared strobe.

FIG. 3 illustrates an embodiment of a hand held covert signal 70 containing a covert near infrared strobe. The signal 70 is a rocket-propelled, fin-stabilized item which is hand-fired from an expendable-type launcher. It is used for ground-to-ground as well as ground-to-air signalling. The covert near infrared strobe produces no visible emission while providing an intense emission at 0.7 to 1 microns. The parachute signal provides covert target marking and signalling capability.

The signal 70 includes a primer 72 and a black powder igniter composition 74 which is used to ignite a primary black powder expulsion charge 76 and the black powder propellant 78. A washer and disc assembly 80 separates the igniter composition 74 from the primary expulsion charge 76.

To activate the firing sequence, the firing cap and spring clip assembly (not shown) are removed and placed over the primer 72. The firing cap should be slowly slid into position where the top of the firing cap is even with the standard red firing ring painted on the outside of the signal case. At this position, the primer is approximately one inch from the firing pin and should be handled with caution. Prior to launch, it is necessary to ensure that the primer end of the signal is oriented in the downward position. The end with the cork assembly 82 should be pointed up and away from the person launching the signal at approximately a 45° angle. To launch the signal, the signal canister 84 is rigidly held at arms length from the body with one hand while bringing the other hand up quickly striking the firing cap into the primer 72.

The primer ignites the black powder igniter composition 74 which in turn ignites the primary black powder expulsion charge 76 and the pressed black powder propellant 78. The propellant rapidly expels the signal body 86 out of the signal canister 84 deploying the stabilizer fins 88 and igniting the delay assembly 90. The signal is propelled to a maximum altitude of about 750 feet above ground level. At maximum altitude, the delay assembly 90 ignites the secondary expulsion charge 92. A bulkhead 91 separates the delay assembly 90 and expulsion charge 92. The expulsion charge 92 expels the strobe assembly 94 and parachute assembly 96 out of the signal body 86. The strobe assembly 94 is attached to the parachute assembly 96 via parachute cable 98. Immediately upon exiting the signal body, the strobe assembly 94 begins pulsating and the parachute 96 is deployed.

From the foregoing, it will be appreciated that the present invention provides a covert target marker which does not emit visible light but which is capable of marking target during the day or night.

The present invention may be embodied in other specific forms without departing from its essential characteristics. The described embodiments are to be considered in all respects only as illustrative and not restrictive. The scope of the invention is, therefore, indicated by the appended claims rather than by the foregoing description.

The claimed invention is:

1. A multispectral target marker comprising:

a canister containing a smoking-producing pyrotechnic composition which produces visible smoke but does not emit visible light, said canister having an exterior surface coated with a material to enhance the exterior surface's emissivity;

a plurality of near infrared emitting photodiodes embedded within a hardened polymeric material which is transparent to near infrared emissions, said photodiodes emitting light having a wavelength in the range from 0.4 microns to 1 microns;

a quantity of radar chaff sized to attenuate radar emissions; and a delivery vehicle for transporting the canister, near infrared emitting photodiodes, and radar chaff to a desired target.

2. A multispectral target marker as defined in claim 1, wherein the delivery vehicle is a 60 mm mortar fired cartridge, 81 mm mortar fired cartridge, and 120 mm mortar fired cartridge, 105 mm howitzer fired cartridges, 155 mm projectiles, 2.75 inch (70 mm) rocket launched cartridges, or 40 mm hand launched signals.

3. A multispectral target marker as defined in claim 1, wherein the exterior surface of the canister has an emissivity in the range from 0.8 to 1.0.

4. A multispectral target marker as defined in claim 1, wherein the exterior surface of the canister has an emissivity greater than 0.9.

5. A multispectral target marker as defined in claim 1, wherein the exterior surface of the canister is coated with flat black paint.

6. A multispectral target marker as defined in claim 1, wherein the exterior surface of the canister is coated with carbon.

7. A multispectral target marker as defined in claim 1, wherein the radar chaff includes small aluminized fiberglass fibers.

8. A multispectral target marker as defined in claim 1, wherein the radar chaff is sized to attenuate radar emissions in the region from 5 to 50 gigahertz.

9. A multispectral target marker as defined in claim 1, further comprising an explosive charge for dispersing the radar chaff.

10. A multispectral target marker as defined in claim 1, wherein the smoking-producing pyrotechnic composition includes an organic acid.

11. A multispectral target marker as defined in claim 1, wherein the smoking-producing pyrotechnic composition includes a colored dye.

12. A multispectral target marker as defined in claim 1, wherein the near infrared emitting photodiodes are embedded within a polyurethane material.

13. A multispectral target marker as defined in claim 1, wherein the near infrared emitting photodiodes are embedded within a polymeric material shaped in the form of a thick disk.

14. A multispectral target marker as defined in claim 1, wherein the near infrared emitting photodiodes emit light in the 0.7 to 1 micron region.

15. A multispectral target marker comprising:

a canister containing an organic acid smoking-producing pyrotechnic composition which produces visible smoke but does not emit visible light, said canister having an exterior surface coated with a material to enhance the exterior surface's emissivity such that the exterior surface of the canister has an emissivity in the range from 0.8 to 1.0;

a plurality of near infrared emitting photodiodes embedded within a hardened polymeric material which is transparent to near infrared emissions, said polymeric material being shaped in the form of a thick disk, said photodiodes emitting light having a wavelength in the range from 0.4 microns to 1 microns;

a quantity of radar chaff sized to attenuate radar emissions in the region from 5 to 50 gigahertz;

an explosive charge for dispersing the radar chaff; and a delivery vehicle for transporting the canister, near infrared emitting photodiodes, and radar chaff to a desired target.

16. A multispectral target marker as defined in claim 15, wherein the delivery vehicle is a 60 mm mortar fired cartridge, 81 mm mortar fired cartridge, and 120 mm mortar fired cartridge, 105 mm howitzer fired cartridges, 155 mm projectiles, 2.75 inch (70 mm) rocket launched cartridges, or 40 mm hand launched signals.

17. A multispectral target marker as defined in claim 15, wherein the exterior surface of the canister has an emissivity greater than 0.9.

18. A multispectral target marker as defined in claim 15, wherein the exterior surface of the canister is coated with flat black paint.

19. A multispectral target marker as defined in claim 15, wherein the exterior surface of the canister is coated with carbon.

20. A multispectral target marker as defined in claim 15, wherein the radar chaff includes small aluminized fiberglass fibers.

21. A multispectral target marker as defined in claim 15, wherein the smoking-producing pyrotechnic composition includes a colored dye.

22. A multispectral target marker as defined in claim 15, wherein the near infrared emitting photodiodes are embedded within a polyurethane material.

23. A hand-fired, rocket-propelled covert target marker comprising:

a tubular target marker canister;

a solid propellant charge located at the aft end of the target marker canister;

near infrared emitting photodiodes embedded within a hardened polymeric material which is transparent to near infrared emissions, said photodiodes emitting light having a wavelength in the range from 0.4 microns to 1 microns, said photodiodes being located within the target marker canister;

a parachute tethered to the photodiodes;

a pyrotechnic expulsion charge for expelling the photodiodes and the parachute from the target marker canister; and a hand-held rocket launcher for launching the target marker.

24. A covert target marker as defined in claim 23, further comprising a plurality of aerodynamic fins located at the aft end of the target marker canister.

25. A covert target marker as defined in claim 23, further comprising an igniter for igniting the solid propellant.

* * * * *